US010839749B2

(12) United States Patent
Hong

(10) Patent No.: US 10,839,749 B2
(45) Date of Patent: Nov. 17, 2020

(54) DISPLAY DEVICE AND CONTROLLER

(71) Applicant: LG DISPLAY CO., LTD., Seoul (KR)

(72) Inventor: MooKyoung Hong, Jinhae-si (KR)

(73) Assignee: LG Display Co., Ltd., Seoul (KR)

( * ) Notice: Subject to any disclaimer, the term of this patent is extended or adjusted under 35 U.S.C. 154(b) by 252 days.

(21) Appl. No.: 15/682,927

(22) Filed: Aug. 22, 2017

(65) Prior Publication Data

US 2018/0061319 A1 Mar. 1, 2018

(30) Foreign Application Priority Data

Aug. 31, 2016 (KR) ..... 10-2016-0111413

(51) Int. Cl.

*G09G 3/3241* (2016.01)
*G09G 3/20* (2006.01)
*G09G 3/36* (2006.01)

(52) U.S. Cl.

CPC ..... *G09G 3/3241* (2013.01); *G09G 3/20* (2013.01); *G09G 3/2011* (2013.01); *G09G 3/3659* (2013.01); *G09G 2230/00* (2013.01); *G09G 2310/0267* (2013.01); *G09G 2320/0219* (2013.01)

(58) Field of Classification Search

CPC .. G09G 3/2011; G09G 3/3241; G09G 3/3659; G09G 3/20; G09G 2320/0219; G09G 2320/00; G09G 2310/0267

See application file for complete search history.

(56) References Cited

U.S. PATENT DOCUMENTS 5,940,055 A * 8/1999 Lee ..... G09G 3/3677 345/87
2004/0155851 A1* 8/2004 Morii ..... G09G 3/3659 345/99
2007/0024560 A1* 2/2007 Kim ..... G09G 3/3614 345/94
2011/0157123 A1* 6/2011 Cho ..... G09G 3/3266 345/211

FOREIGN PATENT DOCUMENTS

CN 102110405 A 6/2011

OTHER PUBLICATIONS

First Notification of Office Action issued in corresponding Chinese Patent Application No. 201710702461.7 dated Jun. 2, 2020.

* cited by examiner

*Primary Examiner* — Ariel A Balaoing
(74) *Attorney, Agent, or Firm* — Morgan, Lewis & Bockius LLP

(57) ABSTRACT

A display device includes: a plurality of gate lines in a display panel, a gate driver configured to sequentially output scan signals to the plurality of gate lines, a gate pulse modulation integrated circuit configured to: receive an input of a gate high voltage used to generate the scan signals, modulate the gate high voltage, and output the modulated gate high voltage to the gate driver, and a controller configured to: output a gate clock signal to the gate driver, output a gate pulse modulation signal to the gate pulse modulation integrated circuit, count a number of times the gate pulse modulation signal is output, and output an output compensation signal to the gate pulse modulation integrated circuit when the number of times is identical to a number of the plurality of gate lines.

8 Claims, 10 Drawing Sheets

DISPLAY DEVICE AND CONTROLLER

CROSS-REFERENCE TO RELATED APPLICATIONS

This application claims the priority of Korean Application No. 10-2016-0111413, filed on Aug. 31, 2016, the entirety of which is hereby incorporated by reference.

BACKGROUND

1. Technical Field

The present disclosure relates to a display device and a controller included in a display device.

2. Discussion of the Related Art

With the development of an information society, various demands for display devices for displaying images have increased, and various types of display devices, such as a liquid crystal display device, a plasma display device, and an organic light emitting display device, have been utilized. This display device includes a display panel, including a plurality of gate lines and a plurality of data lines arranged therein, and subpixels defined in areas where the gate lines and the data lines intersect are arranged, a gate driver that derives the plurality of gate lines, a data driver that derives the plurality of data lines, and a controller that controls driving of the gate driver and the data driver. When a scan signal is output from the gate driver under control of the controller, the display device displays an image by supplying a data voltage to each of the subpixels by the data driver according to timing for outputting the scan signal.

Each of the subpixels that displays an image according to the scan signal may include a driving transistor and at least one capacitor. The driving transistor of each subpixel is turned on according to a gate high voltage of the scan signal supplied to the gate lines, and functions to charge a capacitor with a data signal supplied to the data lines. Further, the capacitor of each subpixel maintains a turn-on state of the driving transistor by using charged voltage when a gate low voltage of the scan signal is supplied to the gate lines.

At the time of a falling edge of the scan signal, which corresponds to a time when the gate high voltage of the scan signal falls to the gate low voltage, the voltage charged to the capacitor of each subpixel decreases as much as a kickback voltage generated due to parasitic capacitance of the driving transistor. The voltage of the capacitor fluctuates due to the kickback voltage, and an image abnormality, such as flicker, afterimage, or color deviation, thus occurs in the displayed image.

To prevent a kickback phenomenon occurring in subpixels within the display panel, a gate pulse modulation integrated circuit is used to modulate the gate high voltage. However, when a gate pulse modulation integrated circuit is used to modulate the gate high voltage, there exists a problem in that an output characteristic of a particular gate line varies due to a load and coupling of the gate line.

SUMMARY

Accordingly, the present disclosure is directed to a display device and controller that substantially obviate one or more of the issues due to limitations and disadvantages of the related art.

In one aspect, embodiments of the present disclosure may provide a display device that prevents a characteristic of a scan signal output to a particular gate line from changing when a gate pulse modulation integrated circuit is used to prevent a kickback phenomenon in the display panel.

In another aspect, embodiments of the present disclosure may provide a display device that prevents an image abnormality for each position in a display panel, which occurs due to a difference in an output waveform of a scan signal when a gate pulse modulation integrated circuit is used.

Additional features and aspects will be set forth in the description that follows, and in part will be apparent from the description, or may be learned by practice of the inventive concepts provided herein. Other features and aspects of the inventive concepts may be realized and attained by the structure particularly pointed out in the written description, or derivable therefrom, and the claims hereof as well as the appended drawings.

To achieve these and other aspects of the inventive concepts as embodied and broadly described, there is provided a display device, including: a plurality of gate lines in a display panel, a gate driver configured to sequentially output scan signals to the plurality of gate lines, a gate pulse modulation integrated circuit configured to: receive an input of a gate high voltage used to generate the scan signals, modulate the gate high voltage, and output the modulated gate high voltage to the gate driver, and a controller configured to: output a gate clock signal to the gate driver, output a gate pulse modulation signal to the gate pulse modulation integrated circuit, count a number of times the gate pulse modulation signal is output, and output an output compensation signal to the gate pulse modulation integrated circuit when the number of times is identical to a number of the plurality of gate lines.

In another aspect, there is provided a display device, including: a display panel including: a plurality of gate lines arranged therein, and one or more dummy lines in parallel with the gate lines, a gate driver configured to sequentially output scan signals to the plurality of gate lines and the one or more dummy lines, a gate pulse modulation integrated circuit configured to: receive an input of a gate high voltage for generation of the scan signals, modulate the gate high voltage, and output the modulated gate high voltage to the gate driver, and a controller configured to: output a gate clock signal to the gate driver, and output a gate pulse modulation signal to the gate pulse modulation integrated circuit.

In another aspect, there is provided a controller, including: a modulation signal output unit configured to output a gate pulse modulation signal to a gate pulse modulation integrated circuit, a counter configured to count the number of times the gate pulse modulation signal is output, and a compensation signal output unit configured to output an output compensation signal to the gate pulse modulation integrated circuit when a number of times the gate pulse modulation signal is output is identical to a number of gate lines arranged in the display panel.

Other systems, methods, features and advantages will be, or will become, apparent to one with skill in the art upon examination of the following figures and detailed description. It is intended that all such additional systems, methods, features and advantages be included within this description, be within the scope of the present disclosure, and be protected by the following claims. Nothing in this section should be taken as a limitation on those claims. Further aspects and advantages are discussed below in conjunction with the embodiments of the disclosure. It is to be understood that both the foregoing general description and the following detailed description of the present disclosure are examples and explanatory, and are intended to provide further explanation of the disclosure as claimed.

BRIEF DESCRIPTION OF THE DRAWINGS

The accompanying drawings, which are included to provide a further understanding of the disclosure and are incorporated in and constitute a part of this specification, illustrate embodiments of the disclosure and together with the description serve to explain various principles of the disclosure.

Figure 1:
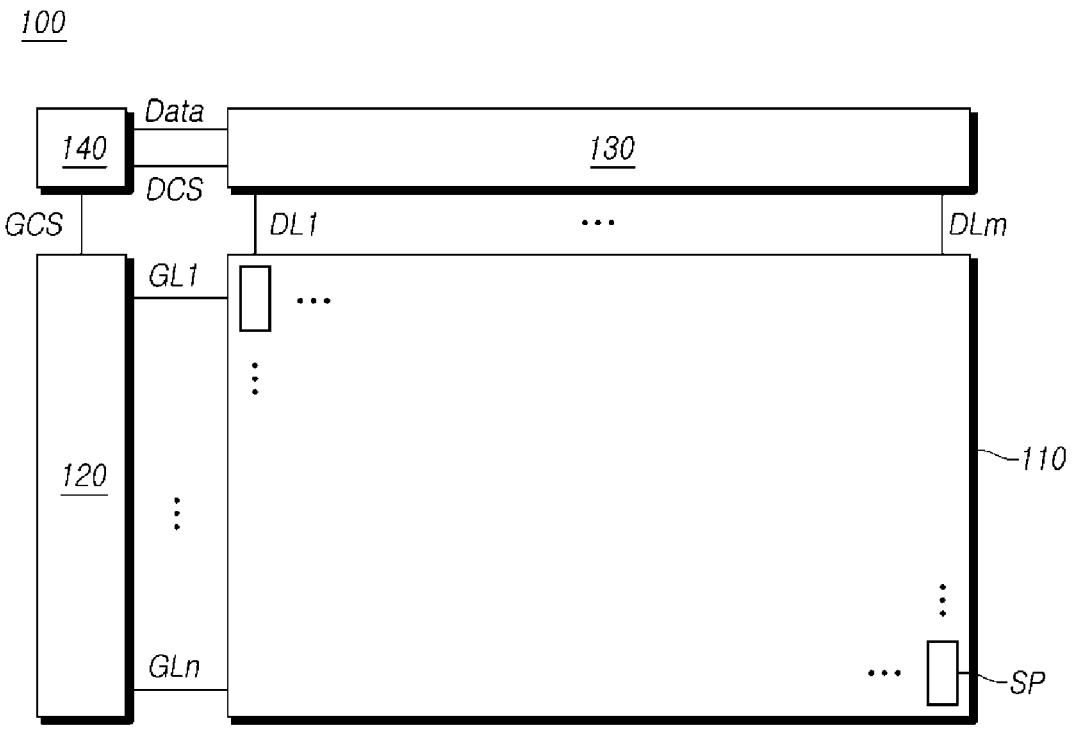
FIG. 1 is a diagram illustrating a schematic configuration of a display device according to an example embodiment.

Throughout the drawings and the detailed description, unless otherwise described, the same drawing reference numerals should be understood to refer to the same elements, features, and structures. The relative size and depiction of these elements may be exaggerated for clarity, illustration, and convenience.

DETAILED DESCRIPTION

Reference will now be made in detail to some embodiments of the present disclosure, examples of which are illustrated in the accompanying drawings. In the following description, when a detailed description of well-known functions or configurations related to this document is determined to unnecessarily cloud a gist of the inventive concept, the detailed description thereof will be omitted. The progression of processing steps and/or operations described is an example; however, the sequence of steps and/or operations is not limited to that set forth herein and may be changed as is known in the art, with the exception of steps and/or operations necessarily occurring in a particular order. Like reference numerals designate like elements throughout. Names of the respective elements used in the following explanations are selected only for convenience of writing the specification and may be thus different from those used in actual products.

In the description of embodiments, when a structure is described as being positioned "on or above" or "under or below" another structure, this description should be construed as including a case in which the structures contact each other as well as a case in which a third structure is disposed therebetween.

FIG. 1 is a diagram illustrating a schematic configuration of a display device 100 according to an example embodiment.

With reference to FIG. 1, the display device 100 according to an example embodiment may include a display panel 110 that may include a plurality of gate lines GL (e.g., gate lines GL1 . . . GLn) and a plurality of data lines DL (e.g., data lines DL1 . . . DLm) arranged therein, and may include a plurality of pixels SP arranged in areas where the gate lines GL and the data lines DL intersect, a gate driver 120 that drives the plurality of gate lines GL, a data driver 130 that supplies data voltage to the plurality of data lines DL, and a controller 140 that may control driving of the gate driver 120 and the data driver 130.

The gate driver 120 may sequentially supply scan signals to the plurality of gate lines GL, and may sequentially drive the plurality of gate lines GL. The gate driver 120 may sequentially supply scan signals of on-voltage or off-voltage to the plurality of gate lines GL according to control of the controller 140 to sequentially drive the plurality of gate lines GL.

The gate driver 120 may be positioned at one side of the display panel 110, or may be positioned at both sides of the display panel 110 according to a driving scheme. Further, the gate driver 120 may include one or more gate driver integrated circuits.

Each of the gate driver integrated circuits may be connected to a bonding pad of the display panel 110, e.g., by using a Tape Automated Bonding (TAB) scheme or a Chip On Glass (COG) scheme, or may be implemented in a Gate In Panel (GIP) type and may be directly disposed in the display panel 110. Alternatively, the gate driver integrated circuits may be integrated and arranged in the display panel 110, and may be implemented in a Chip On Film (COF) scheme by which the gate driver integrated circuits are mounted on a film connected with the display panel 110.

The gate driver integrated circuits may receive inputs of a gate start signal (VST), a clock signal (CLK), a reset signal (RST), and the like, and may generate scan signals based on input signals. The gate driver integrated circuits may sequentially output the generated scan signals to the plurality of gate lines GL to drive the gate lines GL.

The data driver 130 may drive the plurality of data lines DL by supplying a data voltage to the plurality of data lines DL. When a particular gate line GL is open (e.g., in an ON state), the data driver 130 may convert image data (Data) received from the controller 140 into a data voltage having an analog form, and may supply the data voltage to the plurality of data lines DL to drive the plurality of data lines DL.

The data driver 130 may include one or more source driver integrated circuits to drive the plurality of data lines DL. Each of the source driver integrated circuits may be connected to a bonding pad of the display panel 110, e.g., by using a Tape Automated Bonding (TAB) scheme or a Chip On Glass (COG) scheme, may be directly disposed in the display panel 110, or may be integrated and disposed in the display panel 110.

Further, each of the source driver integrated circuits may be implemented in a Chip On Film (COF) scheme. In this case, one end of each source driver integrated circuit may be bonded to at least one source printed circuit board, and the other end thereof may be bonded to the display panel 110.

The controller 140 may supply various types of control signals to the data driver 120 and the gate driver 130 to control the data driver 120 and the gate driver 130. The controller 140 may start a scan according to timing implemented in each frame, may switch input image data received from the outside according to a data signal format used in the data driver 130, may output the switched image data, and may control data driving according to a proper time based on the scan. The controller 140 may receive various timing signals, including a vertical synchronization signal (Vsync), a horizontal synchronization signal (Hsync), an input Data Enable (DE) signal, a clock signal (CLK), and the like, as well as the input image data from the outside (for example, a host system).

In addition to switching the input image data received from the outside according to the data signal format used in the data driver 130 and outputting the switched image data, the controller 140 may receive timing signals, such as a vertical synchronization signal (Vsync), a horizontal synchronization signal (Hsync), an input Data Enable (DE) signal, a clock signal (CLK), etc., to generate various control signals, and may output the generated control signals to the gate driver 120 and the data driver 130 to control the gate driver 120 and the data driver 130.

For example, to control the gate driver 120, the controller 140 may output various Gate Control Signals (GCSs), including a Gate Start Pulse (GSP), a Gate Shift Clock (GSC), a Gate Output Enable (GOE) signal, and the like. For example, the gate start pulse (GSP) may control operation start timing of one or more gate driver integrated circuits constituting the gate driver 120. The gate shift clock (GSC) may be a clock signal commonly input to one or more gate driver integrated circuits, and may control shift timing of a scan signal. The gate output enable (GOE) signal may designate timing information of one or more gate driver integrated circuits.

Further, to control the data driver 130, the controller 140 may output various Data Control Signals (DCSs), including a Source Start Pulse (SSP), a Source Sampling Clock (SSC), a Source Output Enable (SOE) signal, and the like. For example, the source start pulse (SSP) may control data sampling start timing of one or more source driver integrated circuits constituting the data driver 130. The source sampling clock (SSC) may be a clock signal that may control sampling timing of data in each source driver integrated circuit. The source output enable (SOE) signal may control output timing of the data driver 130.

The controller 140 may be disposed on a control printed circuit board that is connected with a source printed circuit board, to which source driver integrated circuits are bonded, e.g., through a flexible flat cable (FFC), a flexible printed circuit (FPC), or the like.

The control printed circuit board may further include a power controller (not illustrated) disposed thereon, which may supply various voltages or currents to the display panel 110, the gate driver 120, the data driver 130, etc., or may control various voltages or currents to be supplied. This power controller is also referred to as a "power management IC." In addition, embodiments may modulate and/or use a gate high voltage (VGH) for generating a scan signal to prevent a kickback phenomenon occurring in a subpixel within the display panel 110.

Figure 2:
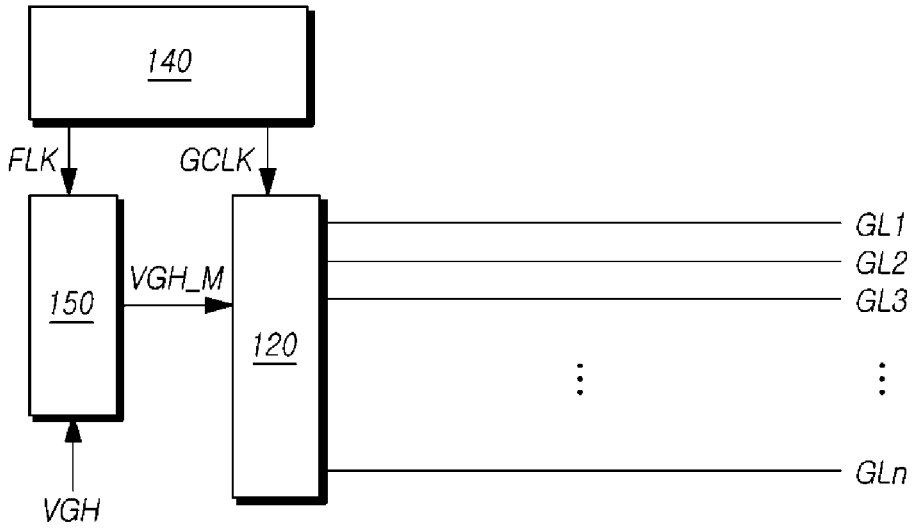
FIG. 2 is a diagram illustrating a configuration of outputting a scan signal in a display device according to an example embodiment.

FIG. 2 is a diagram illustrating a configuration of outputting a scan signal in a display device according to an example embodiment.

FIG. 2 illustrates an example using a gate pulse modulation integrated circuit 150 that may modulate a gate high voltage VGH in the display device 100 according to an example embodiment. With reference to FIG. 2, the gate pulse modulation integrated circuit 150 may receive an input of a gate high voltage VGH output from a power management integrated circuit, and may receive an input of a gate pulse modulation signal FLK from the controller 140. The gate pulse modulation integrated circuit 150 may modulate the gate high voltage VGH by using the gate pulse modulation signal FLK input from the controller 140, and may output the modulated gate high voltage VGH_M to the gate driver 120.

The gate driver 120 may generate a scan signal by using a gate clock signal GCLK output from the controller 140 and the modulated gate high voltage VGH_M output from the gate pulse modulation integrated circuit 150, and may output the generated scan signal to the gate lines GL.

A kickback phenomenon, occurring within the display panel 110, may be prevented by outputting the scan signal by using the gate high voltage VGH_M modulated by the gate pulse modulation integrated circuit 150. However, when the gate pulse modulation integrated circuit 150 is used to improve a kickback phenomenon within the display panel 110, a signal waveform output to a particular gate line GL may vary due to a load and coupling.

Figure 3:
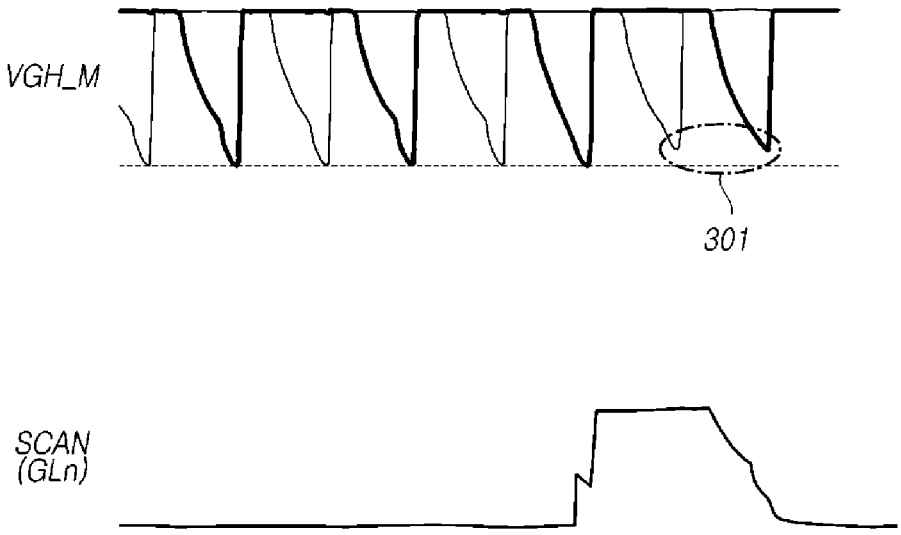
FIGS. 3 and 4 are diagrams illustrating examples of an image and a signal waveform output when a gate pulse modulation integrated circuit is used in a display device according to an example embodiment.
Figure 4:
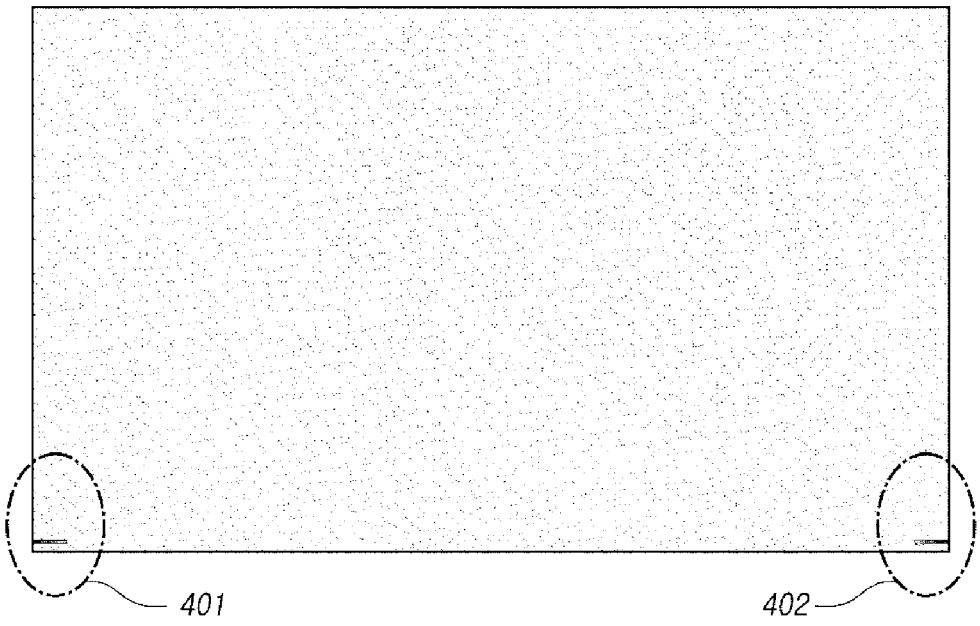

FIGS. 3 and 4 are diagrams illustrating examples of an image and a signal waveform output when a gate pulse modulation integrated circuit is used in a display device according to an example embodiment.

FIG. 3 illustrates a waveform of a signal that is output to a last gate line GL in an example using the gate pulse modulation integrated circuit 150. With reference to FIG. 3, it may be seen that, in output waveforms of a gate high voltage VGH_M modulated by the gate pulse modulation integrated circuit 150, a signal waveform output when a scan signal is output to the last gate line GL is different from a previously output signal waveform, as shown at reference numeral 301. Accordingly, different waveforms of the modulated gate high voltage VGH_M may be supplied to the gate driver 120 from the last gate line GL. Thus, a characteristic of a corresponding signal waveform output by the gate driver 120 may be different from a characteristic of a signal waveform output to a previous gate line GL.

FIG. 4 illustrates the display panel 110 when a scan signal is output according to the signal waveform illustrated in FIG. 3. With reference to FIG. 4, a waveform of a scan signal output by the gate driver 120 becomes different at the last gate line GL, and an image abnormality thus occurs at the left and right edges of the lower end of the display panel 110, as shown at reference numerals 401 and 402.

Embodiments provide a display device 100 that may reduce or prevent a phenomenon, in which a waveform of a signal becomes different depending on the gate line GL, and an image abnormality caused thereby in an example using the gate pulse modulation integrated circuit 150 to prevent a kickback phenomenon within the display panel 110.

Figure 5:
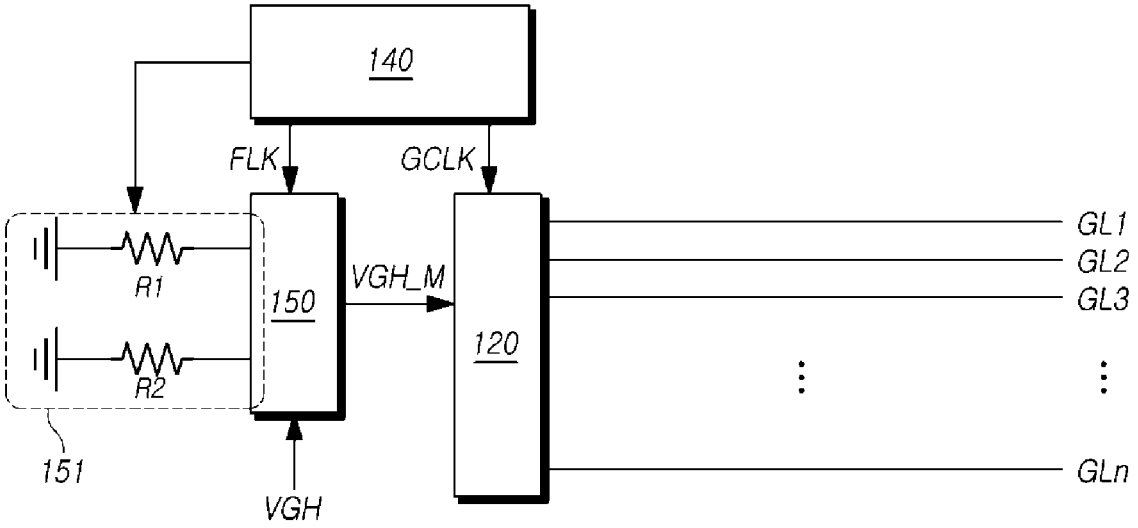
FIGS. 5 and 6 are diagrams illustrating a configuration of adjusting an output of a gate pulse modulation integrated circuit in a display device according to a first embodiment.
Figure 6:
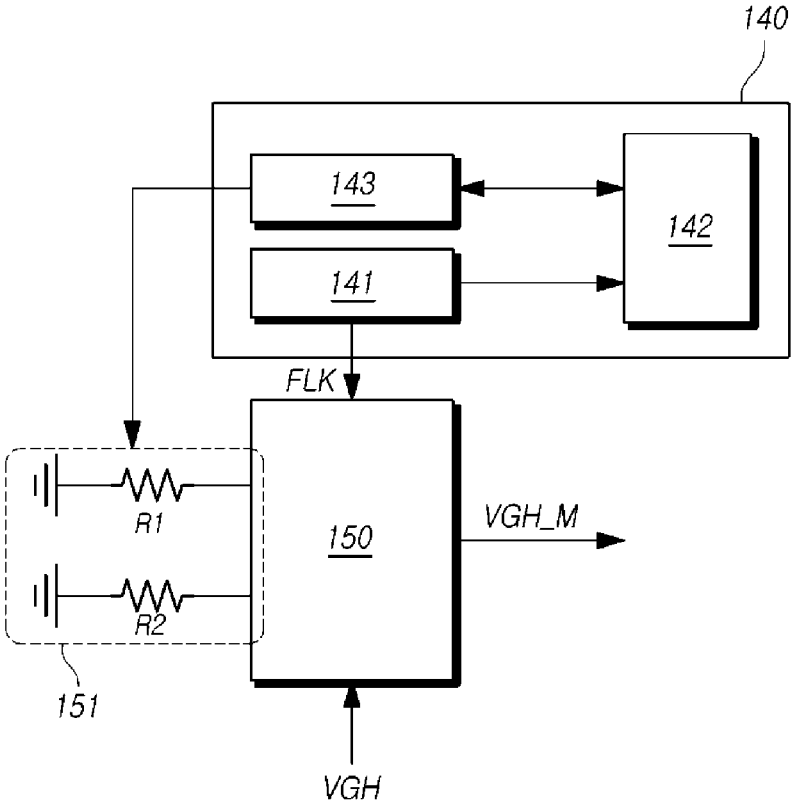

FIGS. 5 and 6 are diagrams illustrating a configuration of adjusting an output of a gate pulse modulation integrated circuit in a display device according to a first embodiment.

FIG. 5 illustrates a configuration of the display device 100 according to a first embodiment, and illustrates an example of adjusting a waveform of a signal output by the gate pulse modulation integrated circuit 150. With reference to FIG. 5, the display device 100 according to the first embodiment may include the plurality of gate lines GL arranged in the display panel 110, the gate driver 120 that may output scan signals to the gate lines GL, the gate pulse modulation integrated circuit 150 that may output a modulated gate high voltage VGH_M, and the controller 140 that may output a gate pulse modulation signal FLK and a gate clock signal GCLK and may control driving of the gate driver 120.

The controller 140 may output the gate pulse modulation signal FLK to the gate pulse modulation integrated circuit 150, and may output the gate clock signal GCLK to the gate driver 120. The gate pulse modulation integrated circuit 150 may receive an input of a gate high voltage VGH output from the power management integrated circuit, and may modulate the gate high voltage VGH by using the gate pulse modulation signal FLK input from the controller 140. The gate pulse modulation integrated circuit 150 may output the modulated gate high voltage VGH_M to the gate driver 120.

The gate driver 120 may generate scan signals by using the gate clock signal GCLK received from the controller and the modulated gate high voltage VGH_M received from the gate pulse modulation integrated circuit 150, and may sequentially output the generated scan signals to the gate lines GL.

At this time, a signal waveform of the modulated gate high control VGH_M output by the gate pulse modulation integrated circuit 150 may be differently output at a last gate line GL. Thus, a corresponding scan signal output by the gate driver 120 may be affected thereby.

In the display device 100 according to the first embodiment, the gate pulse modulation integrated circuit 150 may be controlled by an output compensation signal that may be output by the controller 140 to constantly maintain a signal waveform of the modulated gate high control VGH_M output by the gate pulse modulation integrated circuit 150. In the display device 100 according to the first embodiment, the controller 140 may output the gate pulse modulation signal FLK to the gate pulse modulation integrated circuit 150, and counts the output gate pulse modulation signal FLK.

The controller 140 may count the number of times the gate pulse modulation signal FLK is output, and may output an output compensation signal to the gate pulse modulation integrated circuit 150 when the number of times is identical to the number of the gate lines GL arranged in the display panel 110. That is, the controller 140 may output the output compensation signal to the gate pulse modulation integrated circuit 150 at a modulation timing of a gate high voltage VGH for generating a scan signal output to the last gate line GL disposed on the display panel 110. The controller 140 may output the output compensation signal to the gate pulse modulation integrated circuit 150, and may cause the gate pulse modulation integrated circuit 150 to output a modulated gate high voltage VGH_M having the same signal waveform as that of the previously-output modulated gate high voltage VGH_M.

Accordingly, the gate driver 120 may output a scan signal by using the modulated gate high voltage VGH_M having an identical signal waveform. Thus, it is possible to reduce or prevent a phenomenon in which a waveform of a scan signal becomes different depending on the gate line GL. Therefore, an image abnormality in a particular gate line GL may be prevented in an example using the gate pulse modulation integrated circuit 150 to prevent a kickback phenomenon within the display panel 110.

FIG. 6 illustrates a configuration of the controller 140 in the display device 100 according to the first embodiment. With reference to FIG. 6, the controller 140 in the display device 100 according to the first embodiment may include a modulation signal output unit 141, a counter 142, and a compensation signal output unit 143. The modulation signal output unit 141 may control output of a gate pulse modulation signal FLK that is output to the gate pulse modulation integrated circuit 150. The modulation signal output unit 141 may output a gate pulse modulation signal FLK, and may increase the number of times the counter 142 counts according to output of the gate pulse modulation signal FLK. The counter 142 may count the number of times the gate pulse modulation signal FLK is output by the modulation signal output unit 141, and may transfer the counted number of times to the compensation signal output unit 143.

The compensation signal output unit 143 may check the number of times the gate pulse modulation signal FLK is output, which may be counted by the counter 142, and may output an output compensation signal to the gate pulse modulation integrated circuit 150 when the number of times the gate pulse modulation signal FLK is output is the same as the number of the gate lines GL arranged on the display panel 110. The compensation signal output unit 143 may output an output compensation signal to control an output compensation unit 151 that may adjust an output signal waveform of the gate pulse modulation integrated circuit 150.

For example, the compensation signal output unit 143 may control a signal waveform output by the gate pulse modulation integrated circuit 150 by changing a first resistance value R1 for adjusting of a falling slope of a signal waveform of the modulated gate high voltage VGH_M that may be output by the gate pulse modulation integrated circuit 150. That is, because a lower limit in a waveform of a gate high voltage VGH used for generation of a scan signal, output to a last gate line GL, may be formed higher than a lower limit in a waveform of a previous signal, the compensation signal output unit 143 may enable the gate pulse modulation integrated circuit 150 to output a modulated gate high voltage VGH_M having a waveform identical to the waveform of the previous signal by increasing the falling slope of the signal.

The compensation signal output unit 143 may adjust an output waveform of the modulated gate high voltage VGH_M to have an identical waveform, and thus may maintain a waveform of a scan signal constant to reduce or prevent an image abnormality occurring at a position where a particular gate line GL is disposed. The scan signal may be output using the modulated gate high voltage VGH_M.

As another example, the compensation signal output unit 143 may output an output compensation signal that may change a second resistance value R2 for adjusting a lower limit of a signal waveform of a modulated gate high voltage VGH_M that may be output by the gate pulse modulation integrated circuit 150. The output compensation signal output by the compensation signal output unit 143 may adjust a lower limit of a signal waveform output by the gate pulse modulation integrated circuit 150 to be the same as that of a previously-output signal waveform.

The compensation signal output unit 143 may maintain the lower limit of the modulated gate high voltage VGH_M to be constant to enable the signal waveform of the modulated gate high voltage VGH_M that may be output by the gate pulse modulation integrated circuit 150 to be constantly maintained. Accordingly, the compensation signal output unit 143 may enable a scan signal, which may be output using a modulated gate high voltage VGH_M, to maintain a constant signal waveform to reduce or prevent an image abnormality occurring in a particular gate line GL.

Figure 7:
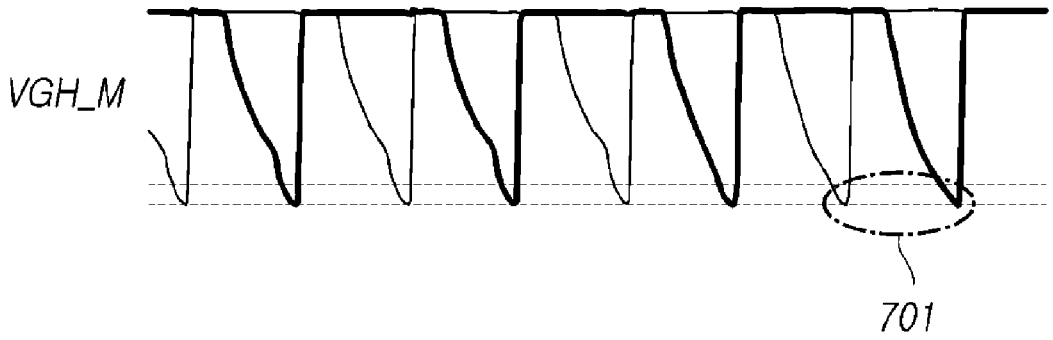
FIG. 7 is a diagram illustrating an example of a signal waveform output by a gate pulse modulation integrated circuit of a display device according to the first embodiment.

FIG. 7 is a diagram illustrating an example of a signal waveform output by a gate pulse modulation integrated circuit of a display device according to the first embodiment.

FIG. 7 illustrates a signal waveform of a modulated gate high voltage VGH_M output by the gate pulse modulation integrated circuit 150 in the display device 100 according to the first embodiment. With reference to FIG. 7, the output compensation unit 151 of the gate pulse modulation integrated circuit 150 may be controlled by an output compensation signal output by the controller 140.

An output compensation signal may cause a falling slope of a modulated gate high voltage VGH_M used for generation of a scan signal output to a last gate line GL to be increased, or a lower limit of the modulated gate high voltage VGH_M to be decreased. Therefore, a signal waveform of the modulated gate high voltage VGH_M used for generation of the scan signal of the last gate line GL may be maintained to be identical to previous signal waveforms, as shown at reference numeral 701.

The gate driver 120 may output a scan signal by using the modulated gate high voltage VGH_M having an identical signal waveform. Thus, it is possible to maintain a waveform of the scan signal can be maintained constant, thereby reducing or preventing a phenomenon in which an image abnormality occurs due to a difference in the waveform of the scan signal.

Figure 8:
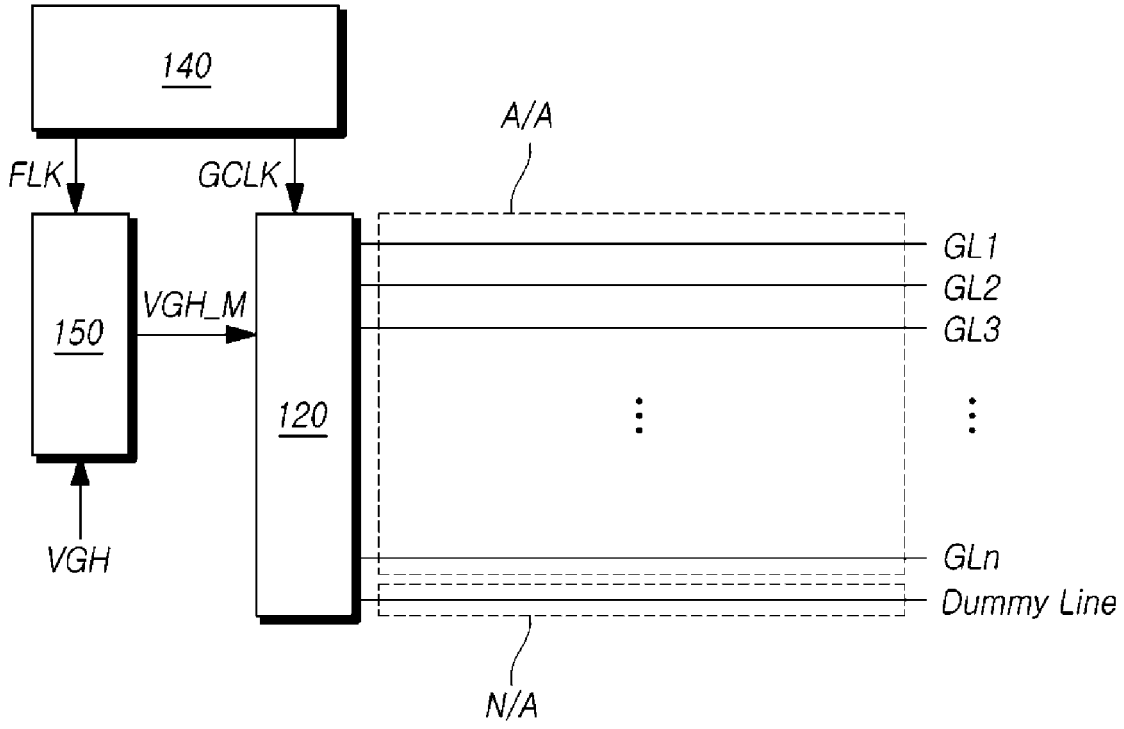
FIG. 8 is a diagram illustrating a display panel and a gate pulse modulation integrated circuit in a display device according to a second embodiment.

FIG. 8 is a diagram illustrating a display panel and a gate pulse modulation integrated circuit in a display device according to a second embodiment.

FIG. 8 illustrates the gate pulse modulation integrated circuit 150 and the gate lines GL arranged in the display panel 110 in the display device 100 according to the second embodiment. With reference to FIG. 8, the display panel 110 in the display device 100 according to the second embodiment may have the plurality of gate lines GL sequentially arranged therein, and may include one or more dummy lines (Dummy Lines) arranged in parallel with the gate lines GL.

In the display panel 110, the plurality of gate lines GL may be arranged in a display area (A/A) in which an image is displayed, and the dummy lines may be arranged in a non-display area (N/A) in which no image is displayed. The dummy lines may be arranged subsequent to a gate line GL to which a last scan signal of scan signals sequentially output is applied.

Further, the scan signals output by the gate driver 120 may be sequentially applied to the plurality of gate lines GL, and then may be applied to the dummy lines. That is, the scan signals generated using a modulated gate high voltage VGH_M, which may be output by the gate pulse modulation integrated circuit 150 and may have different waveforms, may be applied to the dummy lines. Therefore, an image abnormality can be reduced or prevented in an arrangement using the gate pulse modulation integrated circuit 150 by applying a scan signal having an identical waveform to the gate lines GL arranged in the display area of the display panel 110.

In addition, when the gate drivers 120 are disposed on both sides of the display panel 110, the same number of dummy lines as the number of the gate drivers 120 may be arranged subsequent to the gate line GL to which a last scan signal of scan signals output by each of the gate drivers 120 is applied. A scan signal having an identical waveform may be applied to the last gate line GL by arranging the same number of dummy lines as the number of the gate drivers 120.

Further, a signal having different waveforms output by the gate pulse modulation integrated circuit 150 may not affect an image displayed in the display panel 110 by applying a scan signal generated using a modulated gate high voltage VGH_M having different waveforms to the dummy lines.

Figure 9:
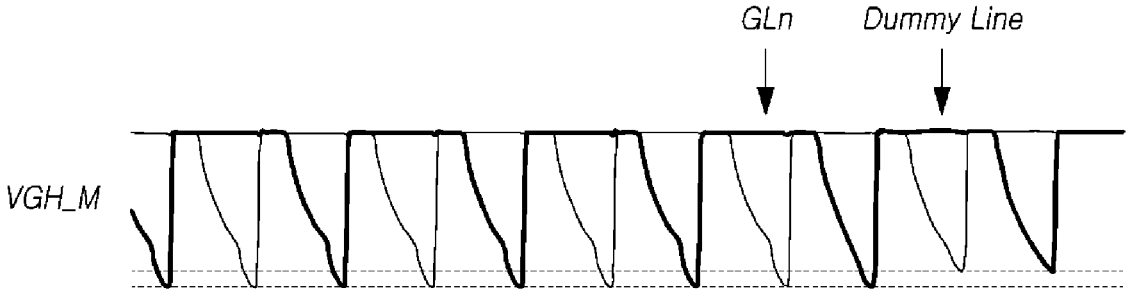
FIG. 9 is a diagram illustrating an example of a signal waveform output by a gate pulse modulation integrated circuit of a display device according to the second embodiment.

FIG. 9 is a diagram illustrating an example of a signal waveform output by a gate pulse modulation integrated circuit of a display device according to the second embodiment.

FIG. 9 illustrates a signal waveform output by the gate pulse modulation integrated circuit 150 of the display device 100 according to the second embodiment. With reference to FIG. 9, a modulated gate high voltage VGH_M having an identical waveform may be output at a timing of outputting scan signals to the plurality of gate lines GL by arranging dummy lines subsequent to the plurality of gate lines GL arranged in the display area of the display panel 110.

Then, a modulated gate high voltage VGH_M having different waveforms may be used at the time of generating scan signals output to the dummy lines subsequent to the last gate line GL to reduce or prevent an image abnormality from appearing on the display panel 110.

Figure 10:
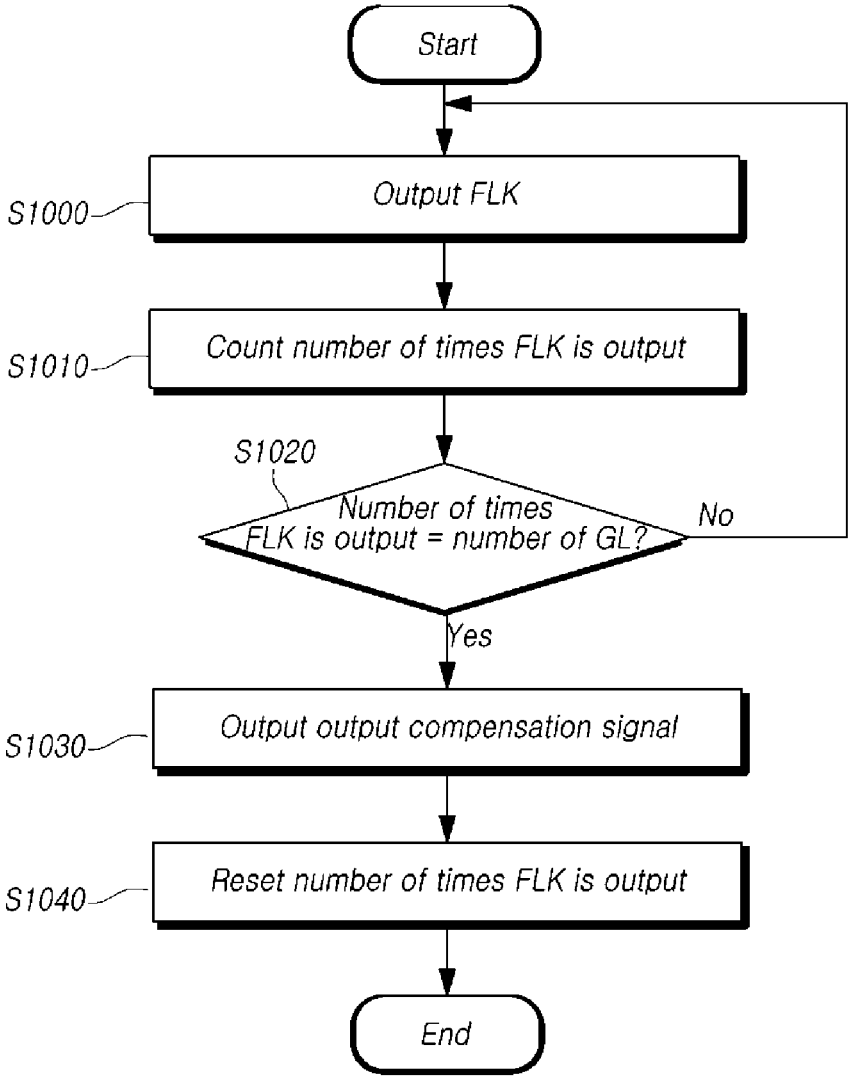
FIG. 10 is a flow chart illustrating a method of driving a display device according to an example embodiment.

FIG. 10 is a flow chart illustrating a method of driving a display device according to an example embodiment.

With reference to FIG. 10, the controller 140 in the display device 100 according to an example embodiment may output a gate pulse modulation signal FLK to the gate pulse modulation integrated circuit 150 (S1000). The controller 140 may count the number of times the gate pulse modulation signal FLK is output to the gate pulse modulation integrated circuit 150 (S1010). The controller 140 may check (or determine) whether the number of times of the gate pulse modulation signal FLK is output is identical to the number of the gate lines GL arranged in the display panel 110 (S1020), and outputs an output compensation signal to the gate pulse modulation integrated circuit 150 (S1030) when (based on the determination that) the counted number of times is identical to the number of the gate lines GL. The controller 140 may reset the number of times the gate pulse modulation signal FLK is output (S1040) when outputting the output compensation signal, and then may count the number of times the gate pulse modulation signal FLK is output again.

According to an example embodiment, in an example using the gate pulse modulation integrated circuit 150, a waveform of a signal output by the gate pulse modulation integrated circuit 150 may be compensated for at a time of outputting a scan signal to a particular gate line GL by counting the number of times the gate pulse modulation signal FLK is output. It may be possible to maintain a waveform of a modulated gate high voltage VGH_M, which may be used to generate a scan signal applied to the particular gate line GL, to be constant by compensating for the waveform of the signal output by the gate pulse modulation integrated circuit 150. It may be possible to reduce or prevent an image abnormality caused by a difference in the waveform of the scan signal applied to the particular gate line GL by maintaining the waveform of the modulated gate high voltage (VGH_M) constant.

It will be apparent to those skilled in the art that various modifications and variations may be made in the present disclosure without departing from the technical idea or scope of the disclosure. Thus, it is intended that embodiments of the present disclosure cover the modifications and variations of the disclosure provided they come within the scope of the appended claims and their equivalents.

What is claimed is:

1. A display device, comprising:

a display panel comprising:

a plurality of gate lines arranged therein; and one or more dummy lines in parallel with the gate lines;

a gate driver configured to sequentially output scan signals to the plurality of gate lines and the one or more dummy lines;

a gate pulse modulation integrated circuit configured to:

receive an input of a gate high voltage for generation of the scan signals;

modulate the gate high voltage; and output the modulated gate high voltage to the gate driver; and a controller configured to:

output a gate clock signal to the gate driver; and output a gate pulse modulation signal to the gate pulse modulation integrated circuit, wherein a waveform of the modulated gate high voltage to be used to generate the scan signal applied to the one or more dummy lines has a different falling edge from waveforms of the modulated gate high voltage to be used to generate the scan signal applied to the gate lines.

2. The display device of claim 1, wherein:

the plurality of gate lines are in a display area of the display panel; and the one or more dummy lines are arranged in a non-display area of the display panel.

3. The display device of claim 1, wherein the one or more dummy lines are subsequent to a gate line to which a last scan signal of the scan signals that are sequentially output by the gate driver is applied.

4. The display device of claim 1, wherein the scan signals are:

sequentially applied to the plurality of gate lines; and subsequently applied to the one or more dummy limes.

5. The display device of claim 1, wherein the scan signal having a different waveform from the scan signal output to the gate lines is output to the one or more dummy lines.

6. The display device of claim 1, wherein at least one of a falling slope and a lower limit of the modulated gate high voltage to be used to generate the scan signal applied to the one or more dummy lines is different from those of waveforms of the modulated gate high voltage to be used to generate the scan signal applied to the gate lines.

7. The display device of claim 1, wherein:

at least two gate drivers are included in the display panel; and the number of the one or more dummy lines is the same as the number of gate drivers.

8. The display device of claim 1, wherein the waveforms of the modulated gate high voltage to be used to generate the scan signals applied to the gate lines are identical.

* * * * *